United States Patent [19]

Triggs et al.

[11] 4,370,811

[45] * Feb. 1, 1983

[54] APPARATUS FOR MARKING PRESELECTED MEASUREMENTS

[76] Inventors: Dennis R. Triggs, 348 E. Fernwood St., Morton, Ill. 61550; Howard W. Coulter, 12 Oakcrest Dr., Pekin, Ill. 61554

[ * ] Notice: The portion of the term of this patent subsequent to Nov. 18, 1997, has been disclaimed.

[21] Appl. No.: 233,010

[22] Filed: Feb. 9, 1981

[51] Int. Cl.[3] ..... B43L 13/00

[52] U.S. Cl. ..... 33/32 R; 33/1 M; 33/430

[58] Field of Search ..... 33/32 R, 430, 436, 443, 33/447, 1 M, 125 C, 132, 174 PC

[56] References Cited

U.S. PATENT DOCUMENTS

| | | | |
|---|---|---|---|
| 3,727,317 | 4/1973 | Gornowitz | 33/430 |
| 4,069,588 | 1/1978 | Hoppe | 33/1 M |
| 4,233,749 | 11/1980 | Coulter et al. | 33/189 |
| 4,237,617 | 12/1980 | Goussios | 33/1 M X |
| 4,299,031 | 10/1981 | Collins et al. | 33/1 M X |

*Primary Examiner*—Charles E. Phillips
*Attorney, Agent, or Firm*—James R. Bell

[57] ABSTRACT

Automatic marking is accomplished by providing a housing that moves along a calibrated guide. The housing is operably connected with a microcomputer which receives preselected marking data. The housing carries a sensor and a marking device. As the housing moves along the guide, the sensor reads the calibrations and registers same with the data in the microcomputer. In response, the marking device applies appropriate marks on an associated object.

10 Claims, 2 Drawing Figures

APPARATUS FOR MARKING PRESELECTED MEASUREMENTS

CROSS REFERENCE TO RELATED APPLICATIONS

The disclosures of U.S. Pat. No. 4,233,749, issued on Nov. 18, 1980 to Coulter et al., the inventors of the present invention, is incorporated by reference herein.

BACKGROUND OF THE INVENTION

This invention relates generally to geometric instruments and more particularly to those used for marking predetermined intervals of distance.

During the design phase of a project, much time is spent in drawing layouts and details of the product to be manufactured. Generally, drawings are made to a selected scale so as to keep the drawn parts or objects in proportion. A draftsman is required to use a measuring device usually in the form of a rule having various scales and calibrations indicated thereon. In using the measuring device, the draftsman repeatedly picks up the device and lays it on the drawing. Marks are made by the draftsman's pencil to indicate the desired measurements. A limitation here is that the draftsman is required to repeatedly lay the scale on the drawing and make markings on the drawing which are matched with calibrations on the scale.

During manufacture of the parts of a product, repeated measurements and markings are also required. Such measurements and markings are usually made by the use of a calibrated rule or extendable tape that is laid over the part to be marked. Marks are then applied manually at the appropriate place or places on the part by a person using a pencil, pen, or the like. A limitation here is that the person is required, as in the case of the draftsman, to lay the rule on the part and make markings on the part which are matched with the calibrations on the rule.

The foregoing illustrates limitations of the known prior art. Thus, it is apparent that it would be advantageous to provide an alternative directed to overcoming one or more of the limitations as set forth above.

SUMMARY OF INVENTION

In one aspect of the present invention, this is accomplished by providing an apparatus for marking preselected measurements on an object including a housing having an electrical energy source operably connected thereto. A microcomputer contains preselected data and is operably connected with the housing for receiving and storing data. A guiding device includes calibrations at equally spaced intervals. The housing is movably mounted on the guiding device and a sensor on the housing senses relative movement between the housing and the calibrations. The sensing is registered with the data in the microcomputer. In response, a marking device in the housing marks the object in a marking pattern corresponding to the data.

The foregoing and other aspects will become apparent from the following detailed description of the invention when considered in conjunction with the accompanying drawings. It is to be expressly understood, however, that the drawings are not intended as a definition of the invention but are for the purpose of illustration only.

DESCRIPTION OF THE PREFERRED EMBODIMENT

Figure 2:
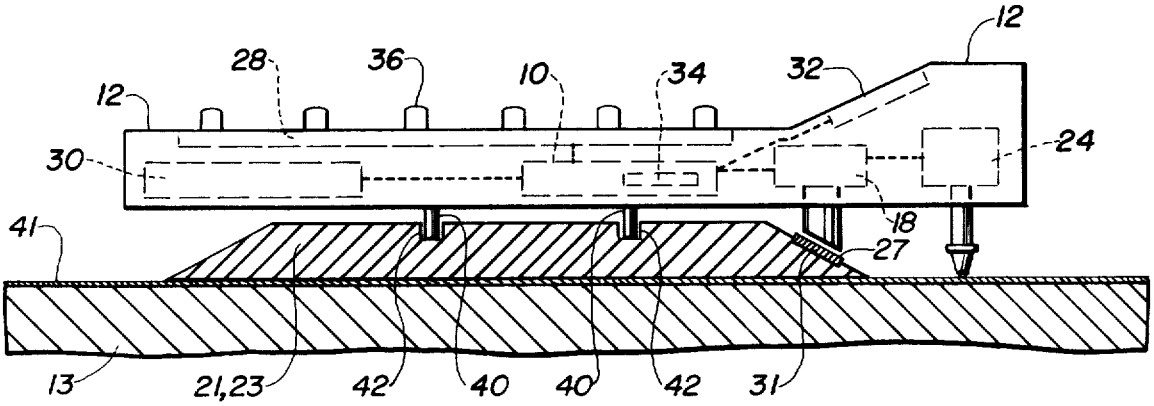
FIG. 2 is a cross-sectional view of an embodiment of the housing taken along the line II—II of FIG. 1.

An apparatus for marking preselected measurements on an object includes a housing 12, FIG. 2, in accordance with U.S. Pat. No. 4,233,749 including operably interconnected components such as a keyboard 28, keys 36, a source of electrical energy 30, a printed circuit 10, a microcomputer 34, an LED display 32, and a marking device 24.

Also operably connected with the above-mentioned components, and different from that previously disclosed, is a contact-free sensor 18 preferably of the type commercially available and used at retail and grocery outlets for reading and recording compatible markings that indicate various information to a remote terminal such as the nature of the goods, price, etc. By "contact-free" is meant the sensor and markings are compatible via light or electromagnetic sensitivity or the like. Such sensors are commonly known as POINT-OF-SALE indicators and are readily usable with the device disclosed in U.S. Pat. No. 4,233,749.

A pair of guide pins 40, extend from housing 12 for moving engagement with a guiding means to be discussed later. Guide pins 40 are of a construction sufficient for permitting movement of housing 12 relative to a guide in a substantially straight line.

Figure 1:
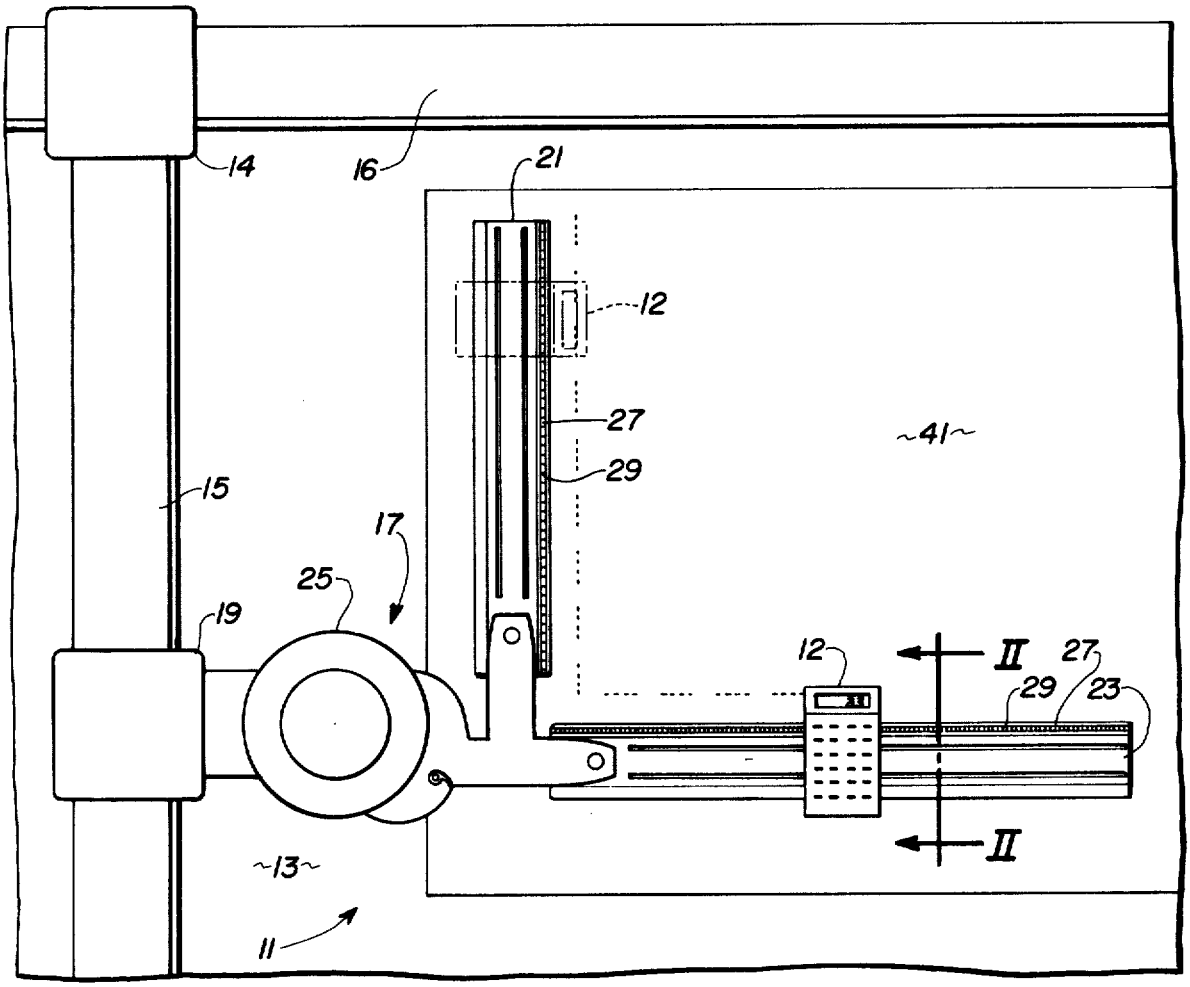
FIG. 1 is a plan view illustrating an embodiment of the marking device of this invention in combination with a mechanical drafting apparatus.

In FIG. 1, an exemplary, well-known, mechanical drafting apparatus is generally designated 11 and includes a drawing board 13, a vertical carriage 15 slidably connected at 14 to a horizontal carriage 16, and a straight-edge device 17 which is slidable connected at 19 to a carriage 15 and includes a vertical straight-edge member 21 and a horizontal straight-edge member 23, each pivotally connected to carriage 15 at pivot 25.

Each straight-edge member 21, 23 comprises a guiding means and includes a calibrated scale 27, FIGS. 1 and 2, including equally spaced marks or calibrations 29 of a material compatible to be sensed by sensor 18. The straight-edge members 21, 23 may have calibrations 29 formed thereon but preferably, members 21, 23 include a groove 31 into which scale 27 is removably seated (see FIG. 2). In this manner other scales having similar calibrations 29 formed at either greater or lesser equal spacings can provide an interchangeable variety of scales for use with apparatus 11. For example, note in FIG. 1 that the spacings on member 21 are greater than the spacings on member 23. Also, each straight-edge member 21, 23 preferably has a pair of grooves 42 (FIG. 2) formed therein for slidably receiving pins 40 of housing 12 such that sensor 18 is positioned adjacent scale 27.

It is anticipated that a single housing 12 may be used interchangeably with straight-edge member 21, 23 or a pair of housings 12 may be simultaneously mounted on straight-edge members 21, 23. In this manner each straight-edge member has an associated housing slidably mounted thereon. It is also anticipated that each housing 12 may be connected to a remote, stationary member which carries printed circuit 10, power source 30, microcomputer 34, keyboard 28, and LED display 32, whereas each housing 12 carries a sensor 18 and a marking device 24.

With the parts assembled as set forth above, housing 12 is movably mounted in grooves 42 at pins 40. A paper 41 or other object to be marked is supported on board 13. Drafting apparatus 11 is maneuvered placing straight-edge members 21, 23 in a desired position. With the preselected data fed into microcomputer 34, housing 12 is moved along and guided by the appropriate straight-edge member 21, 23 and sensor 18 registers relative movement with calibrations 29 on scale 27. At proper intervals, marking device 24 is actuated to mark paper 41 as desired according to the scale being used (see FIG. 1).

Although the foregoing describes the invention in its preferred embodiment, it should be understood that other aspects are possible. In one such aspect, it is anticipated that in a given industry it may be determined that it is more efficient to have a material marked during its manufacture. For example, at the time of manufacture, suppose that large sheets of material (wood, metal, glass, etc.) are automatically marked with calibrations provided at equally spaced intervals. The material would then have its own self-contained calibrated scale. The housing could be moved along the material and the sensor would tell the marking device when and where to strike a mark.

Another possible aspect includes moving material to a particular position for marking. Instead of a guiding means such as the straight-edge of a drafting apparatus, a guide may be provided at a material processing station so that the material can be placed flush against the guide. The guide contains a calibrated scale and the housing is moved along the guide in a position permitting markings to be made on the material.

Still another aspect involves having an entire marking device automated for use without manual assistance by applying the disclosures of this invention.

The foregoing has described an apparatus for marking preselected measurements having a sensor moved relative to a calibrated scale and a marking device actuated to mark an object in response to preselected marks being sensed.

It is anticipated that aspects of the present invention, other than those specifically defined in the appended claims, can be obtained from the foregoing description and the drawings.

Having thus described the invention, what is claimed is:

1. Apparatus for marking preselected measurements on an object, comprising:

a housing, a source of electrical energy operably connected with said housing;

means for receiving and storing preselected data, said data means being a microcomputer operably connected with said housing and connected to said source of electrical energy;

means for engaging and guiding movement of said housing relative to said object in a substantially straight line, said guiding means having calibrations at equally spaced intervals;

means in said housing, connected to said energy source for electrically sensing said calibrations in response to said housing being moved relative to said calibrations and for registering said sensing with said preselected data; and means in said housing connected with said energy source for marking said object in response to said registered sensing of said calibrations, said marking means being electrically energized for urging a color-impregnated marking medium into repeated momentary contact with said object in a spaced marking pattern corresponding to said preselected stored data.

2. The apparatus of claim 1 wherein guide pins extend from said housing into guide grooves formed in said guiding means.

3. The apparatus of claim 1 wherein said housing includes a keyboard and an LED display element operably connected to said microcomputer.

4. The apparatus of claim 1 wherein said calibrations are formed of a material compatible to be sensed by said sensing means.

5. The apparatus of claim 4 wherein said sensing is contact-free.

6. The apparatus of claim 1 including:

a mechanical drafting apparatus, said apparatus having a straight-edge member, said straight-edge member being said guiding means, said housing being detachably mounted in sliding engagement with said straight-edge member.

7. The apparatus of claim 6 including:

a scale of said calibrations detachably mounted on said straight-edge member adjacent said sensing means.

8. The apparatus of claim 6 including:

one of a first and second scale of said calibrations is detachably mounted on said straight-edge member, said first scale having calibrations spaced by an interval of a first distance and said second scale having calibrations spaced by an interval of a second distance less than said first distance.

9. The apparatus of claim 1 including:

a mechanical drafting apparatus having first and second straight-edge members relatively disposed at right angles, said housing being detachably mounted in sliding engagement with either of said first and second straight-edge members.

10. The apparatus of claim 1 including:

a mechanical drafting apparatus having first and second straight-edge members and first and second ones of said housings, said first and second housings detachably mounted in sliding engagement with each of said first and second straight-edge members, respectively.

* * * * *